US011535906B2

(12) United States Patent
Yamashita et al.

(10) Patent No.: US 11,535,906 B2
(45) Date of Patent: Dec. 27, 2022

(54) METHOD FOR MANUFACTURING ALLOY RIBBON PIECE

(71) Applicant: TOYOTA JIDOSHA KABUSHIKI KAISHA, Toyota (JP)

(72) Inventors: Osamu Yamashita, Toyota (JP); Shinichi Hiramatsu, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 187 days.

(21) Appl. No.: 16/872,892

(22) Filed: May 12, 2020

(65) Prior Publication Data

US 2020/0385832 A1 Dec. 10, 2020

(30) Foreign Application Priority Data

Jun. 6, 2019 (JP) ..... JP2019-105932

(51) Int. Cl.
*C21D 8/02* (2006.01)
*C21D 8/12* (2006.01)
(Continued)

(52) U.S. Cl.
CPC ..... *C21D 8/0247* (2013.01); *C21D 8/12* (2013.01); *C21D 9/00* (2013.01); *C22C 45/00* (2013.01); *C21D 2201/03* (2013.01)

(58) Field of Classification Search
None
See application file for complete search history.

(56) References Cited

U.S. PATENT DOCUMENTS

2004/0112468 A1* 6/2004 Petzold ..... H01F 41/0226 148/121
2015/0162118 A1 6/2015 Kato et al.
(Continued)

FOREIGN PATENT DOCUMENTS

DE 101 34 056 A1 1/2003
JP 07-320920 A 12/1995
(Continued)

*Primary Examiner* — Brian D Walck
*Assistant Examiner* — Christopher D. Moody
(74) *Attorney, Agent, or Firm* — Sughrue Mion, PLLC

(57) ABSTRACT

The present disclosure provides a method that ensures easily manufacturing an alloy ribbon piece having excellent soft magnetic properties. The method is a method for manufacturing an alloy ribbon piece obtained by crystallizing an amorphous alloy ribbon piece and including: increasing a temperature of the amorphous alloy ribbon piece to a crystallization starting temperature; and increasing the temperature of the amorphous alloy ribbon piece from the crystallization starting temperature to a crystallization process termination temperature equal to or less than a crystallization completion temperature. A temperature increase rate of the amorphous alloy ribbon piece in the increasing of the temperature of the amorphous alloy ribbon piece from the crystallization starting temperature to the crystallization process termination temperature satisfies $\Delta Q_{self} \leq \Delta Q_{out} + mc\Delta T$ where a self-heating amount, a heat discharge amount, a mass, a specific heat, and a temperature increase width of the amorphous alloy ribbon piece per unit time is $\Delta Q_{self}$, $\Delta Q_{out}$, m, c, and $\Delta T$, respectively.

2 Claims, 5 Drawing Sheets

(51) Int. Cl.
*C22C 45/00* (2006.01)
*C21D 9/00* (2006.01)

(56) References Cited

U.S. PATENT DOCUMENTS

2017/0271063 A1 9/2017 Kato et al.
2020/0335246 A1* 10/2020 Shen ..... C22C 45/02

FOREIGN PATENT DOCUMENTS

JP 2013-118348 A 6/2013
JP 2018-050053 A 3/2018

* cited by examiner

METHOD FOR MANUFACTURING ALLOY RIBBON PIECE

CROSS REFERENCE TO RELATED APPLICATIONS

The present application claims priority from Japanese patent application JP 2019-105932 filed on Jun. 6, 2019, the content of which is hereby incorporated by reference into this application.

BACKGROUND

Technical Field

The present disclosure relates to a method for manufacturing an alloy ribbon piece obtained by crystallizing an amorphous alloy ribbon piece.

Description of Related Art

Conventionally, amorphous alloy ribbon pieces processed from a continuous amorphous alloy ribbon manufactured by a method such as a single roll method and a twin roll method are used for, for example, a motor core. Since a nanocrystalline alloy ribbon piece obtained by crystallizing the amorphous alloy ribbon piece is a soft magnetic material that can provide a high saturation magnetic flux density and a low coercivity at the same time, recently, the nanocrystalline alloy ribbon piece has been used for those cores.

The nanocrystalline alloy ribbon piece is manufactured by heating the amorphous alloy ribbon piece to a temperature at which the amorphous alloy is crystallized. For example, JP 2018-50053 A discloses a method of crystallizing an amorphous alloy ribbon piece through a heating process of heating the amorphous alloy ribbon piece to the temperature of 390° C. or more and 480° C. or less as a method for manufacturing an alloy ribbon piece obtained by crystallizing the amorphous alloy ribbon piece through heating.

SUMMARY

However, in the method for manufacturing alloy ribbon piece obtained by crystallizing the amorphous alloy ribbon piece through heating, when the temperature is simultaneously increased at the whole amorphous alloy ribbon piece to a temperature at which the crystallization of the amorphous alloy is completed in a wide area of the alloy ribbon piece, a problem possibly arises in that, for example, self-heating due to the crystallization simultaneously occurs in the wide area of the amorphous alloy ribbon piece to cause excessive temperature increase on the amorphous alloy ribbon piece, resulting in burning of the alloy ribbon piece. Therefore, a method for easily manufacturing the nanocrystalline alloy ribbon piece having excellent soft magnetic properties without causing such a problem is desired.

The present disclosure has been made in view of such an aspect, and provides a method for manufacturing an alloy ribbon piece that ensures easily manufacturing the alloy ribbon piece having excellent soft magnetic properties.

To solve the above-described problem, a method for manufacturing an alloy ribbon piece according to the present disclosure is a method for manufacturing an alloy ribbon piece obtained by crystallizing an amorphous alloy ribbon piece. The method includes: preparing an amorphous alloy ribbon piece; increasing a temperature of the amorphous alloy ribbon piece to a crystallization starting temperature;

and increasing the temperature of the amorphous alloy ribbon piece from the crystallization starting temperature to a crystallization process termination temperature equal to or less than a crystallization completion temperature. A temperature increase rate of the amorphous alloy ribbon piece in the increasing of the temperature of the amorphous alloy ribbon piece from the crystallization starting temperature to the crystallization process termination temperature satisfies a formula (1) below where a self-heating amount of the amorphous alloy ribbon piece per unit time is $\Delta Q_{self}$, a heat discharge amount of the amorphous alloy ribbon piece per unit time is $\Delta Q_{out}$, a mass and a specific heat of the amorphous alloy ribbon piece are m and c, respectively, and a temperature increase width of the amorphous alloy ribbon piece per unit time is $\Delta T$.

$$\Delta Q_{self} \leq \Delta Q_{out} + mc\Delta T \quad (1)$$

Effect

The present disclosure ensures facilitated manufacturing of the alloy ribbon pieces having excellent soft magnetic properties.

DETAILED DESCRIPTION OF THE EMBODIMENTS

Figure 1A:
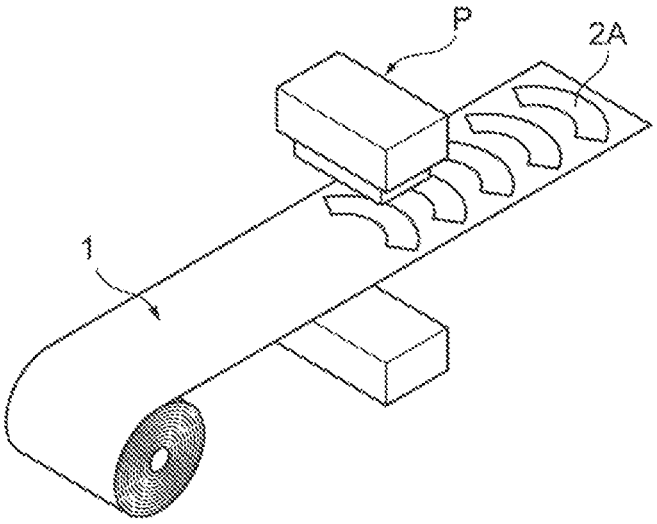
FIGS. 1A to 1C are schematic process drawings illustrating an exemplary method for manufacturing alloy ribbon pieces of the embodiment.

The following describes an embodiment of a method for manufacturing an alloy ribbon piece according to the present disclosure.

The method for manufacturing alloy ribbon piece according to the embodiment is a method for manufacturing an alloy ribbon piece obtained by crystallizing an amorphous alloy ribbon piece. The method includes: a preparation step of preparing the amorphous alloy ribbon piece; a first temperature increasing step of increasing a temperature of the amorphous alloy ribbon piece to a crystallization starting temperature; and a second temperature increasing step of increasing the temperature of the amorphous alloy ribbon piece from the crystallization starting temperature to a crystallization process termination temperature equal to or less than a crystallization completion temperature. A temperature increase rate of the amorphous alloy ribbon piece in the second temperature increasing step satisfies a formula (1) below where a self-heating amount of the amorphous alloy ribbon piece per unit time is $\Delta Q_{self}$, a heat discharge amount of the amorphous alloy ribbon piece per unit time is $\Delta Q_{out}$, a mass and a specific heat of the amorphous alloy ribbon piece are m and c, respectively, and a temperature increase width of the amorphous alloy ribbon piece per unit time is $\Delta T$.

$$\Delta Q_{self} \leq \Delta Q_{out} + mc\Delta T \quad (1)$$

Here, the "crystallization starting temperature" means a temperature at which the crystallization of the amorphous alloy starts at any portion of the amorphous alloy ribbon piece when the temperature of the amorphous alloy ribbon piece increases, and the "crystallization completion temperature" means a temperature at which the crystallization of the amorphous alloy is completed at all the portions of the amorphous alloy ribbon piece when the temperature of the amorphous alloy ribbon piece increases. The crystallization of the amorphous alloy differs depending on the material and the like of the amorphous alloy, and in the case of a Fe-based amorphous alloy, the crystallization of the amorphous alloy means that, for example, a fine bccFe crystal is precipitated. The "crystallization process termination temperature" means a temperature which is equal to or less than the crystallization completion temperature and is set such that characteristic values, such as a saturation magnetic flux density and a coercivity, of the alloy ribbon piece obtained by the crystallization of the amorphous alloy ribbon piece are desired values.

The "temperature increase rate of the amorphous alloy ribbon piece in the second temperature increasing step" is a temperature increase rate of the amorphous alloy ribbon piece in the temperature increase process from the crystallization starting temperature to the crystallization process termination temperature (hereinafter simply referred to as "temperature increase process" in some cases), and means a rate of the temperature increase caused by a heat transferred from an external environment to the amorphous alloy ribbon piece. Therefore, the "temperature increase rate of the amorphous alloy ribbon piece in the second temperature increasing step" does not include a rate of the temperature increase caused by a heat generated by the self-heating due to the crystallization of the amorphous alloy ribbon piece.

Furthermore, the "self-heating amount of the amorphous alloy ribbon piece per unit time" means an amount of a heat generated by the self-heating due to the crystallization of the amorphous alloy ribbon piece per unit time in the temperature increase process. The "heat discharge amount of the amorphous alloy ribbon piece per unit time" means an amount of a heat discharged from the amorphous alloy ribbon piece to the external environment per unit time in the temperature increase process. Furthermore, the "temperature increase width of the amorphous alloy ribbon piece per unit time" means a temperature increase width when the temperature of the amorphous alloy ribbon piece is increased by the heat transferred from the external environment to the amorphous alloy ribbon piece per unit time in the temperature increase process. Therefore, the "temperature increase width of the amorphous alloy ribbon piece per unit time" does not include a temperature increase width when the temperature of the amorphous alloy ribbon piece is increased by the heat generated by the self-heating due to the crystallization of the amorphous alloy ribbon piece per unit time in the temperature increase process.

First, the method for manufacturing alloy ribbon piece of the embodiment will be described with an example.

Figure 4:
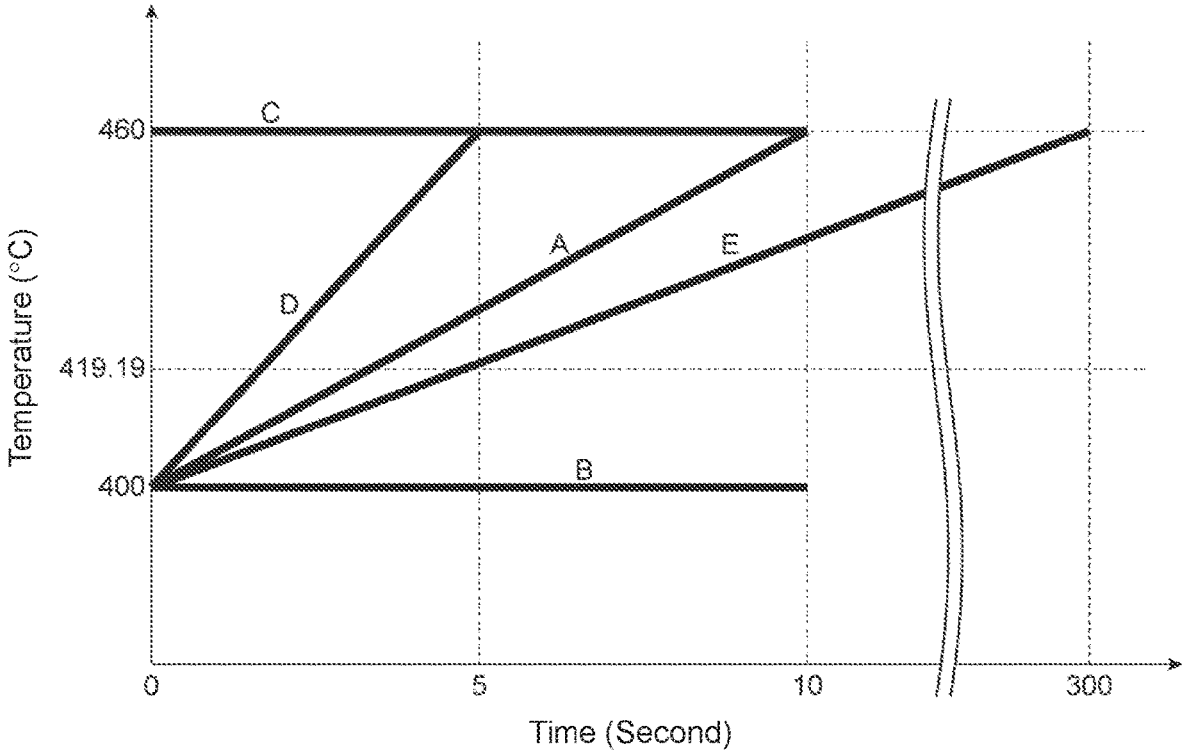
FIG. 4 is a graph schematically illustrating a temperature history of a heating furnace in the exemplary method for manufacturing alloy ribbon pieces of the embodiment with temperature histories of the heating furnace in exemplary conventional methods for manufacturing alloy ribbon pieces.
Figure 5:
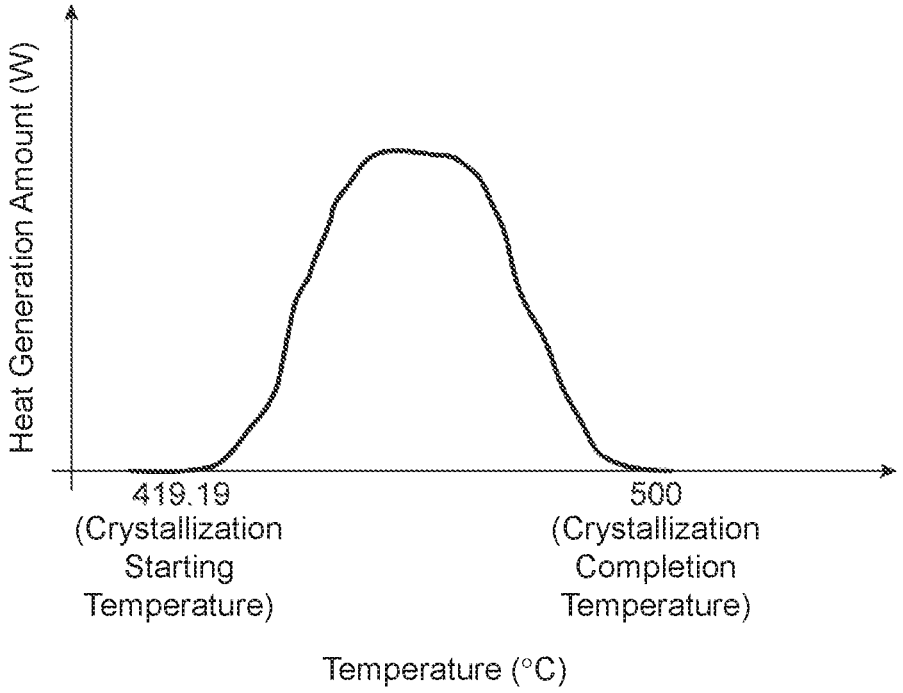
FIG. 5 is a graph schematically illustrating an exemplary DSC curve of amorphous alloy ribbon pieces measured by a differential scanning calorimeter (DSC).

Here, FIG. 1A to FIG. 3C are schematic process drawings illustrating an exemplary method for manufacturing alloy ribbon piece of the embodiment. FIG. 4 is a graph schematically illustrating a temperature history of a heating furnace in the exemplary method for manufacturing alloy ribbon piece of the embodiment with temperature histories of the heating furnace in exemplary conventional methods for manufacturing alloy ribbon piece. FIG. 5 is a graph schematically illustrating an exemplary DSC curve of amorphous alloy ribbon pieces measured by a differential scanning calorimeter (DSC).

In the example of the embodiment, first, as illustrated in FIG. 1A, by punching a continuous sheet-shaped amorphous alloy ribbon 1, which is manufactured by a common method, with a pressing machine P, a plurality of amorphous alloy ribbon pieces 2A are manufactured and prepared (preparation step). The amorphous alloy ribbon pieces 2A are each a ribbon having a shape where an annular alloy ribbon constituting a stator core of a motor is circumferentially divided in one third.

Figure 1B:
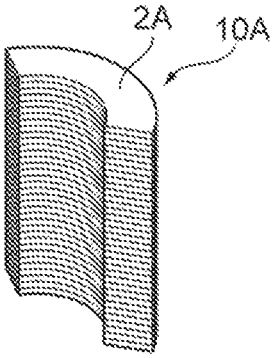
Figure 1C:
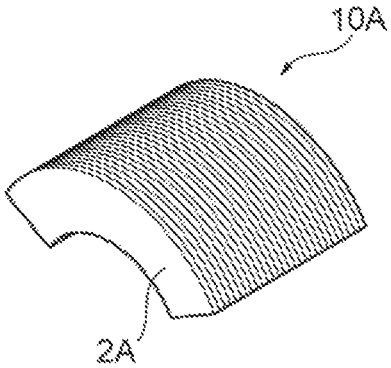
Figure 2A:
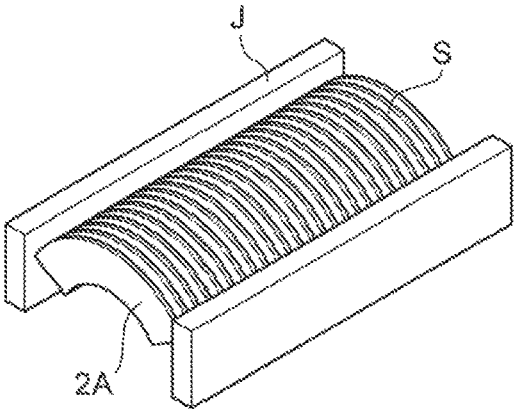
FIGS. 2A to 2C are schematic process drawings illustrating the exemplary method for manufacturing the alloy ribbon pieces of the embodiment.

Next, as illustrated in FIG. 1B, the plurality of amorphous alloy ribbon pieces 2A are laminated to form a laminated body 10A. Next, as illustrated in FIG. 1C and FIG. 2A, the laminated body 10A is put sideways, and a jig J including a pair of plate-shaped members is used to fix the laminated body 10A by sandwiching the plurality of amorphous alloy ribbon pieces 2A at circumferential both ends with a clearance S provided between the adjacent amorphous alloy ribbon pieces 2A.

Figure 2B:
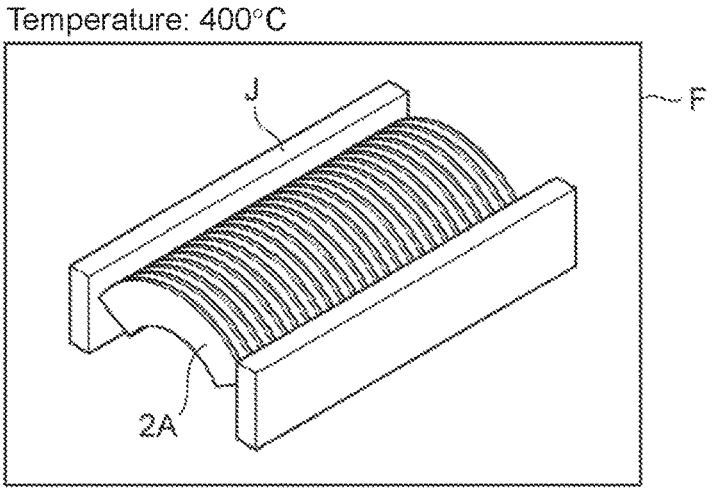

Next, as illustrated in FIG. 2B and a temperature history A of FIG. 4, the plurality of amorphous alloy ribbon pieces 2A are moved from an environment of normal temperature to inside a heating furnace F where the temperature is set to 400° C., thus increasing the temperature of the plurality of amorphous alloy ribbon pieces 2A to 400° C.

Figure 2C:
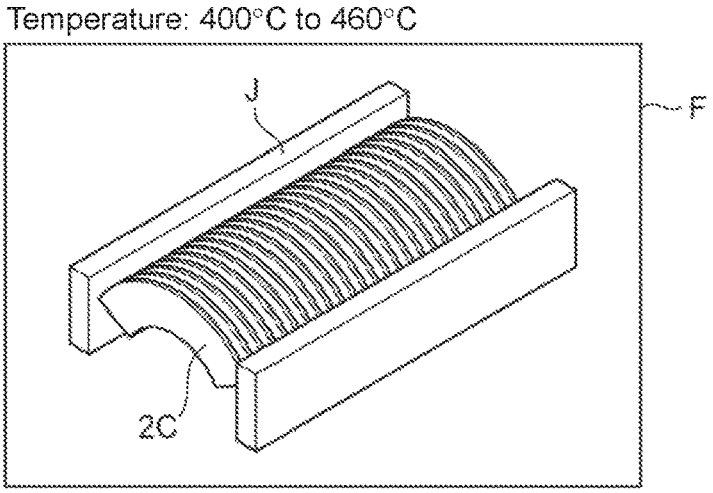

Next, as illustrated in FIG. 2C and the temperature history A of FIG. 4, the temperature of the heating furnace F is increased from 400° C. to 460° C. in 10 seconds at a uniform temperature increase rate (6° C./second). With this process, in the state where the clearances S are provided between the adjacent amorphous alloy ribbon pieces 2A, the temperature of the plurality of amorphous alloy ribbon pieces 2A is increased from 400° C. to 419.19° C. (crystallization starting temperature) at the uniform temperature increase rate (6° C./second), and subsequently, increased from 419.19° C. (crystallization starting temperature) to 460° C. (crystallization process termination temperature), which is equal to or less than the crystallization completion temperature (500° C.), at the uniform temperature increase rate (6° C./second) (a first temperature increasing step and a second temperature increasing step).

For one amorphous alloy ribbon piece, the temperature at which the amorphous alloy crystallizes is different for each portion. That is, one amorphous alloy ribbon piece has a portion where the amorphous alloy crystallizes at a relatively low temperature and a portion where the amorphous alloy crystallizes at a relatively high temperature. Accordingly, during the temperature increase of the amorphous alloy ribbon piece 1, as seen from the DSC curve illustrated in FIG. 5, the self-heating due to the crystallization continuously occurs from 419.19° C. (crystallization starting temperature), at which the crystallization of the amorphous alloy starts at any portion, to 500° C. (crystallization completion temperature), at which the crystallization of the amorphous alloy is completed at all the portions, thus generating a heat. In the DSC curve illustrated in FIG. 5, the temperature at which the heat generation amount peaks is, for example, 427.22° C. The characteristic of the amorphous alloy ribbon piece described in this paragraph will be hereinafter referred to as the "characteristic of crystallization reaction of amorphous alloy ribbon piece".

On the premise of the characteristic of crystallization reaction of amorphous alloy ribbon piece, since the heat is sufficiently discharged by the clearance S for each of the amorphous alloy ribbon pieces 2A, the temperature increase rate of the amorphous alloy ribbon piece 2A in the second temperature increasing step satisfies the formula (1) below where a self-heating amount of the amorphous alloy ribbon piece 2A per unit time is $\Delta Q_{self}$, a heat discharge amount of the amorphous alloy ribbon piece 2A per unit time is $\Delta Q_{out}$, a mass and a specific heat of the amorphous alloy ribbon piece 2A are m and c, respectively, and a temperature increase width (temperature increase width of the amorphous alloy ribbon piece 2A per unit time described above) when the temperature of the amorphous alloy ribbon piece 2A is increased by the heat transferred from the external environment inside the heating furnace F to the amorphous alloy ribbon piece 2A per unit time is ΔT. Note that, the temperature increase rate of the amorphous alloy ribbon piece 2A in the second temperature increasing step is the temperature increase rate of the amorphous alloy ribbon piece 2A in the temperature increase process from 419.19° C. (crystallization starting temperature) to 460° C. (crystallization process termination temperature) in the second temperature increasing step, and means the rate of the temperature increase due to the heat transferred from the external environment inside the heating furnace F to the amorphous alloy ribbon piece 2A.

$$\Delta Q_{self} \leq \Delta Q_{out} + mc\Delta T \quad (1)$$

The second temperature increasing step provides a plurality of alloy ribbon pieces 2C where the plurality of amorphous alloy ribbon pieces 2A have been each entirely crystallized.

Figure 3A:
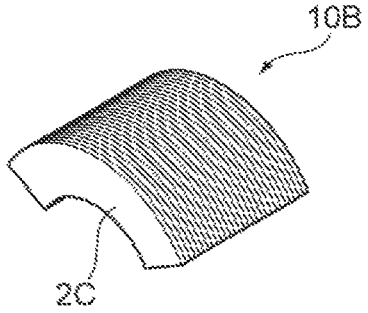
FIGS. 3A to 3C are schematic process drawings illustrating the exemplary method for manufacturing the alloy ribbon pieces of the embodiment.
Figure 3B:
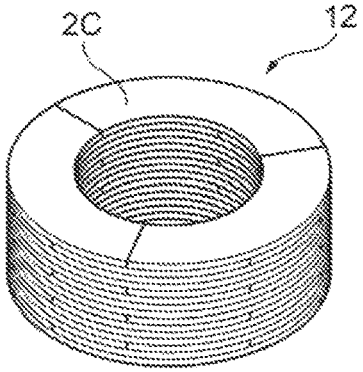
Figure 3C:
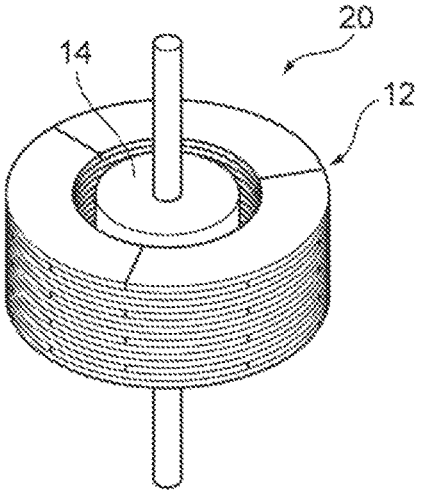

Next, as illustrated in FIG. 3A, the plurality of alloy ribbon pieces 2C are taken out from inside the heating furnace F and moved to the environment of normal temperature to cool the plurality of alloy ribbon pieces 2C to the normal temperature, thus stopping the growth of crystallized crystal grains, and the plurality of alloy ribbon pieces 2C are brought in close contact with one another using a pressure to form a laminated body 10B (cooling step). Thus, a plurality of nanocrystalline alloy ribbon pieces 2C where the plurality of amorphous alloy ribbon pieces 2A have been each entirely crystallized are manufactured. Note that, in the one example of the embodiment, subsequently, as illustrated in FIG. 3B and FIG. 3C, the plurality of nanocrystalline alloy ribbon pieces 2C are rotated and laminated to manufacture a stator core 12, and subsequently, the stator core 12 is combined with a rotor 14, a coil (not illustrated), and a case (not illustrated) to manufacture a motor 20.

Here, conventional examples 1 to 4 will be described as examples according to the conventional method for manufacturing alloy ribbon piece.

In the conventional example 1, as indicated by the temperature history B of FIG. 4, the temperature of the plurality of amorphous alloy ribbon pieces 2A is increased to 400° C., and subsequently the temperature of the heating furnace F is kept at 400° C. for 10 seconds. Thus, a plurality of alloy ribbon pieces are manufactured with the manufacturing method similar to that of the one example of the embodiment excluding the keeping at 400° C. for 10 seconds. In this case, since the temperature of the plurality of amorphous alloy ribbon pieces 2A is increased only up to 400° C., the plurality of amorphous alloy ribbon pieces 2A are each not entirely crystallized because of the characteristic of crystallization reaction of amorphous alloy ribbon piece.

In the conventional example 2, as indicated by the temperature history C of FIG. 4, the temperature of the plurality of amorphous alloy ribbon pieces 2A is increased to 460° C. by moving the plurality of amorphous alloy ribbon pieces 2A from the environment of normal temperature to the inside of the heating furnace F where the temperature is set to 460° C., and subsequently the temperature of the heating furnace F is kept at 460° C. for 10 seconds. Thus, the manufacturing method similar to that of the one example of the embodiment excluding the keeping at 460° C. for 10 seconds is performed. In this case, since the temperature of the plurality of amorphous alloy ribbon pieces 2A is increased to the temperature equal to or more than the temperature at which the respective wide areas of the plurality of amorphous alloy ribbon pieces 2A are simultaneously crystallized, the self-heating due to the crystallization simultaneously occurs in the respective wide areas of the plurality of amorphous alloy ribbon pieces 2A because of the characteristic of crystallization reaction of amorphous alloy ribbon piece. Consequently, a problem arises in that, for example, the respective temperatures of the amorphous alloy ribbon pieces 2A are excessively increased to cause the amorphous alloy ribbon pieces 2A to be burnt.

In the conventional example 3, as indicated by the temperature history D of FIG. 4, in the first temperature increasing step and the second temperature increasing step, the temperature of the heating furnace F is increased from 400° C. to 460° C. in five seconds at a uniform temperature increase rate (12° C./second). Thus, the manufacturing method is performed, and the manufacturing method is similar to that of the one example of the embodiment excluding that the temperature of the plurality of amorphous alloy ribbon pieces 2A is increased from 400° C. to 419.19° C. (crystallization starting temperature) at the uniform temperature increase rate (12° C./second) and subsequently increased from 419.19° C. (crystallization starting temperature) to 460° C. (crystallization process termination temperature) at the uniform temperature increase rate (12° C./second) in the state where the clearances S are provided between the adjacent amorphous alloy ribbon pieces 2A.

In the conventional example 3, on the premise of the above-described characteristic of crystallization reaction of amorphous alloy ribbon piece, for each of the amorphous alloy ribbon pieces 2A, the temperature increase rate of the amorphous alloy ribbon piece 2A in the second temperature increasing step is high compared with the one example of the embodiment. Therefore, the formula (2) below is satisfied when the meanings of $\Delta Q_{self}$, $\Delta Q_{out}$, m, c, and ΔT are similar to those of the formula (1), and further, the temperature increase width of the temperature increase of the amorphous alloy ribbon piece 2A caused by the heat generated by the self-heating due to the crystallization of the amorphous alloy ribbon piece 2A per unit time is $\Delta T_{self}$, $$\Delta Q_{self} = \Delta Q_{out} + mc\Delta T_{self} > \Delta Q_{out} + mc\Delta T \quad (2)$$

When the temperature increase rate of the plurality of amorphous alloy ribbon pieces 2A in the second temperature increasing step satisfies the formula (2) but does not satisfy the formula (1), a difference ($\Delta Q_{self} - \Delta Q_{out}$) between the self-heating amount and the heat discharge amount of the amorphous alloy ribbon pieces 2A in the unit time becomes larger than a heat amount mcΔT necessary for the temperature increase of the amorphous alloy ribbon pieces 2A at the temperature increase width ΔT due to the heat transferred from the external environment inside the heating furnace F to the amorphous alloy ribbon pieces 2A per unit time. Therefore, the temperature of the amorphous alloy ribbon pieces 2A increases by the temperature increase width $\Delta T_{self}$ corresponding to the difference ($\Delta Q_{self}-\Delta Q_{out}$) between the self-heating amount and the heat discharge amount that exceeds the temperature increase width $\Delta T$ by the heat transferred from the external environment to the amorphous alloy ribbon pieces 2A per unit time. Accordingly, because of the above-described characteristic of crystallization reaction of amorphous alloy ribbon piece, the self-heating due to the crystallization occurs in chain reaction at each of the plurality of amorphous alloy ribbon pieces 2A. Consequently, a problem arises in that, for example, the temperatures of the amorphous alloy ribbon pieces 2A are each excessively increased to cause the amorphous alloy ribbon pieces 2A to be burnt.

In the conventional example 4, as indicated by the temperature history E of FIG. 4, in the first temperature increasing step and the second temperature increasing step, the temperature of the heating furnace F is increased from 400° C. to 460° C. in 300 seconds at a uniform temperature increase rate (0.2° C./second). Thus, the manufacturing method is performed, and the manufacturing method is similar to that of the one example of the embodiment excluding that the temperature of the plurality of amorphous alloy ribbon pieces 2A is increased from 400° C. to 419.19° C. (crystallization starting temperature) at the uniform temperature increase rate (0.2° C./second) and subsequently increased from 419.19° C. (crystallization starting temperature) to 460° C. (crystallization process termination temperature) at the uniform temperature increase rate (0.2° C./second) in the state where the clearances S are provided between the adjacent amorphous alloy ribbon pieces 2A. Thus, the plurality of alloy ribbon pieces 2C where the plurality of amorphous alloy ribbon pieces 2A have been each crystallized are manufactured. In this case, since a temperature increasing time of the amorphous alloy ribbon pieces 2A in the second temperature increasing step is excessively long, the crystallized crystal grains grow for a long period of time to be coarsened, consequently deteriorating the soft magnetic properties of the plurality of alloy ribbon pieces 2C in some cases.

In contrast, in the one example of the embodiment, since the temperature increase rate of the amorphous alloy ribbon pieces 2A in the second temperature increasing step is low compared with the conventional example 3 to satisfy the formula (1), the difference ($\Delta Q_{self}-\Delta Q_{out}$) between the self-heating amount and the heat discharge amount of the amorphous alloy ribbon pieces 2A per unit time becomes equal to or less than the heat amount $mc\Delta T$ necessary for the temperature increase of the amorphous alloy ribbon pieces 2A at the temperature increase width $\Delta T$ due to the heat transferred from the external environment inside the heating furnace F to the amorphous alloy ribbon pieces 2A per unit time. Therefore, unlike the conventional example 3, the temperature of the amorphous alloy ribbon pieces 2A does not increase at the temperature increase width exceeding the temperature increase width $\Delta T$ due to the heat transferred from the external environment to the amorphous alloy ribbon pieces 2A per unit time. Accordingly, the occurrence in chain reaction of the self-heating due to the crystallization at each of the plurality of amorphous alloy ribbon pieces 2A because of the characteristic of crystallization reaction of amorphous alloy ribbon piece is suppressed, thereby ensuring suppression of the excessive temperature increase of each of the amorphous alloy ribbon pieces 2A.

Furthermore, in the one example of the embodiment, unlike the conventional example 4, the temperature increasing time of the amorphous alloy ribbon pieces 2A in the second temperature increasing step is not excessively long, thereby ensuring suppression of the growth of the crystallized crystal grains for a long period of time to be coarsened. Accordingly, the nanocrystalline alloy ribbon piece 2C having excellent soft magnetic properties can be manufactured.

Accordingly, the one example of the embodiment can suppress the excessive temperature increase and the coarse crystal grains to manufacture the nanocrystalline alloy ribbon piece having excellent soft magnetic properties only by adjusting the temperature increase rate of the amorphous alloy ribbon piece 2A in the second temperature increasing step without the use of complicated heating facilities.

According to the embodiment, as the one example of the embodiment, the excessive temperature increase is suppressed only by adjusting the temperature increase rate of the amorphous alloy ribbon piece in the second temperature increasing step so as to satisfy the formula (1), thereby ensuring easily manufacturing the alloy ribbon piece having excellent soft magnetic properties. Furthermore, by adjusting the temperature increase rate of the amorphous alloy ribbon piece in the second temperature increasing step to the predetermined rate or more, the coarse crystal grains can be suppressed to easily manufacture the alloy ribbon piece having further excellent soft magnetic properties.

Subsequently, the method for manufacturing alloy ribbon piece according to the embodiment will be described in detail, mainly the conditions in respective steps.

1. Preparation Step

In the preparation step, the amorphous alloy ribbon piece is prepared.

Here, the "amorphous alloy ribbon piece" means, for example, a ribbon piece, which is used for a component such as a core in a final product such as a motor, punched in a desired shape from, for example, a continuous sheet-shaped amorphous alloy ribbon manufactured by a common method such as a single roll method and a twin roll method.

While the amorphous alloy ribbon piece is not specifically limited insofar as the amorphous alloy ribbon piece is a ribbon piece punched in the desired shape, for example, a ribbon constituting a stator core or a rotor core of a motor and a ribbon obtained by further dividing the ribbon constituting the stator core in a circumferential direction are included.

While the material of the amorphous alloy ribbon piece is not specifically limited insofar as the material is the amorphous alloy, for example, a Fe-based amorphous alloy, a Ni-based amorphous alloy, and a Co-based amorphous alloy are included. Especially, the Fe-based amorphous alloy and the like is used in some embodiments. Here, the "Fe-based amorphous alloy" means an amorphous alloy that contains Fe as a main component, and contains impurities such as B. Si, C, P, Cu, Nb, and Zr. The "Ni-based amorphous alloy" means an amorphous alloy that contains Ni as a main component. The "Co-based amorphous alloy" means an amorphous alloy that contains Co as a main component.

The Fe-based amorphous alloy may have, for example, a Fe content in a range of 84 atomic percent or more, and may have a larger Fe content. This is because a magnetic flux density of the alloy ribbon piece obtained by crystallizing the amorphous alloy ribbon piece differs depending on the Fe content.

While the plane size of the amorphous alloy ribbon piece is not specifically limited, for example, general plane sizes of a ribbon constituting a stator core or a rotor core of a motor and a ribbon obtained by further dividing the ribbon constituting the stator core in a circumferential direction are included. While the thickness of the amorphous alloy ribbon piece is not specifically limited, the thickness is different depending on the material and the like of the amorphous alloy ribbon piece. When the material is the Fe-based amorphous alloy, the thickness is, for example, in a range of 10 μm or more and 100 μm or less, and is in a range of 20 μm or more and 50 μm or less in some embodiments.

2. First Temperature Increasing Step

In the first temperature increasing step, the temperature of the amorphous alloy ribbon piece is increased to the crystallization starting temperature.

While the crystallization starting temperature differs depending on the material and the like of the amorphous alloy ribbon piece, when the material is the Fe-based amorphous alloy, the crystallization starting temperature is, for example, in a range of 400° C. or more and 450° C. or less.

While the method for increasing the temperature of the amorphous alloy ribbon piece to the crystallization starting temperature is not specifically limited, the method includes, for example, a method where the amorphous alloy ribbon piece is moved from an inlet to a predetermined position in a continuous heating furnace (for example, a tunnel furnace) in which the temperature at a predetermined position on the inlet side inside the furnace is set to the crystallization starting temperature, the temperature near the outlet inside the furnace is set to the crystallization process termination temperature, and the temperature continuously changes from near the inlet to near the outlet inside the furnace, in addition to the method where the temperature inside the heating furnace into which the amorphous alloy ribbon piece has been moved is increased to the crystallization starting temperature as the example illustrated in FIG. 1A to FIG. 3C.

3. Second Temperature Increasing Step

In the second temperature increasing step, the temperature of the amorphous alloy ribbon piece is increased from the crystallization starting temperature to the crystallization process termination temperature equal to or less than the crystallization completion temperature. The temperature increase rate of the amorphous alloy ribbon piece in the second temperature increasing step satisfies the formula (1) below where a self-heating amount of the amorphous alloy ribbon piece per unit time is $\Delta Q_{self}$, a heat discharge amount of the amorphous alloy ribbon piece per unit time is $\Delta Q_{out}$, a mass and a specific heat of the amorphous alloy ribbon piece are m and c, respectively, and a temperature increase width of the amorphous alloy ribbon piece per unit time is $\Delta T$.

$$\Delta Q_{self} \leq \Delta Q_{out} + mc\Delta T \quad (1)$$

Here, the "unit time" in the "self-heating amount of the amorphous alloy ribbon piece per unit time," the "heat discharge amount of the amorphous alloy ribbon piece per unit time," and the "temperature increase width of the amorphous alloy ribbon piece per unit time" means the temperature increasing time/n (n: natural number), wherein the temperature increasing time is a temperature increasing time from the crystallization starting temperature to the crystallization process termination temperature. The unit time is set to, for example, a time in a range of the temperature increasing time (a temperature increasing time from the crystallization starting temperature to the crystallization process termination temperature) or less, and especially, the unit time is set to a time in a range of one second or less in some embodiments.

The description of the crystallization starting temperature is omitted because it is similar to that of the first temperature increasing step. While the crystallization completion temperature differs depending on the material and the like of the amorphous alloy ribbon piece, when the material is the Fe-based amorphous alloy, the crystallization completion temperature is, for example, in a range of 450° C. or more and 550° C. or less. The crystallization process termination temperature is not specifically limited insofar as the crystallization process termination temperature is a temperature equal to or less than the crystallization completion temperature and is set such that characteristic values such as a saturation magnetic flux density and a coercivity, of the alloy ribbon piece obtained by the crystallization of the amorphous alloy ribbon piece become desired values. While the crystallization process termination temperature differs depending on the material and the like of the amorphous alloy ribbon piece, when the material is the Fe-based amorphous alloy, the crystallization process termination temperature is, for example, set to 460° C. as the example illustrated in FIG. 1A to FIG. 3C. In this case, the crystallization process termination temperature may be set to a temperature less than 460° C. for further suppressing the progress of the crystallization and the growth of the crystal grains to reduce the coercivity, or may be set to a temperature exceeding 460° C. for further crystallization to improve the saturation magnetic flux density.

The temperature increase rate may constantly satisfy the formula (1) in the temperature increase process from the crystallization starting temperature to the crystallization process termination temperature and does not have to constantly satisfy the formula (1) in the temperature increase process insofar as the excessive temperature increase is suppressed to ensure manufacturing the alloy ribbon piece having the desired soft magnetic properties. The temperature increase rate constantly satisfies the formula (1) in the temperature increase process in some embodiments. This is because the excessive temperature increase can be effectively suppressed.

The temperature increase rate may be constant in the temperature increase process from the crystallization starting temperature to the crystallization process termination temperature, or may be changed in the temperature increase process. For example, the temperature increase rate may be relatively increased in a temperature range where the heat generation amount is relatively small on the DSC curve as illustrated in FIG. 5 and relatively decreased in a temperature range where the heat generation amount is relatively large on the DSC curve.

While the average temperature increase rate of the amorphous alloy ribbon piece in the second temperature increasing step differs depending on the material and the like of the amorphous alloy ribbon piece, when the material of the amorphous alloy ribbon piece is the Fe-based amorphous alloy, the average temperature increase rate is, for example, in a range of 0.5° C./second or more and 20° C./second or less, or is in a range of 0.5° C./second or more and 10° C./second or less in some embodiments. This is because the average temperature increase rate equal to or more than the lower limits of these ranges ensures the effective suppression of the coarse crystal grains, and the average temperature increase rate equal to or less than the upper limits of these ranges ensures the effective suppression of the excessive temperature increase. Note that, the average temperature increase rate of the amorphous alloy ribbon piece in the second temperature increasing step means the average of the temperature increase rate in the temperature increase process from the crystallization starting temperature to the crystallization process termination temperature. While the average temperature increase rate differs depending on the material and the like of the amorphous alloy ribbon piece, when the material is the Fe-based amorphous alloy, the average temperature increase rate means, for example, the average of the temperature increase rate in the temperature increase process from the crystallization starting temperature in a range of 400° C. or more and 450° C. or less to the crystallization process termination temperature.

While the method for increasing the temperature of the amorphous alloy ribbon piece from the crystallization starting temperature to the crystallization process termination temperature is not specifically limited, the method includes, for example, a method where the amorphous alloy ribbon piece is moved from an inlet to a predetermined position and subsequently moved from the predetermined position to an outlet in a continuous type heating furnace in which the temperature at a predetermined position on the inlet side inside the furnace is set to the crystallization starting temperature, the temperature near the outlet inside the furnace is set to the crystallization process termination temperature, and the temperature continuously changes from near the inlet to near the outlet inside the furnace, in addition to the method where the temperature inside the heating furnace into which the amorphous alloy ribbon piece has been moved is increased from the crystallization starting temperature to the crystallization process termination temperature at the desired rate as the example illustrated in FIG. 1A to FIG. 3C.

4. Other Step

The method for manufacturing alloy ribbon piece usually includes, for example, the cooling step of cooling the temperature of the alloy ribbon piece obtained by crystallizing the amorphous alloy ribbon piece to a temperature at which the growth of the crystal grains crystallized in the alloy ribbon piece stops after the temperature increase of the amorphous alloy ribbon piece from the crystallization starting temperature to the crystallization process termination temperature in the second temperature increasing step as the example illustrated in FIG. 1A to FIG. 3C.

While the method for cooling the temperature of the alloy ribbon piece obtained by crystallizing the amorphous alloy ribbon piece to the temperature at which the growth of the crystal grains crystallized in the alloy ribbon piece stops is not specifically limited, the method includes, for example, a method for cooling the temperature to normal temperature by taking out the alloy ribbon piece obtained by crystallizing the amorphous alloy ribbon piece from the inside of the heating furnace to move it to the environment of normal temperature as the example illustrated in FIG. 1A to FIG. 3C.

5. Method for Manufacturing Alloy Ribbon Piece

While the method for manufacturing alloy ribbon piece is not specifically limited insofar as the method suppresses the excessive temperature increase to ensure manufacturing the alloy ribbon piece having the desired soft magnetic properties, the method is a method for manufacturing the nanocrystalline alloy ribbon piece having the desired soft magnetic properties in some embodiments.

(1) Nanocrystalline Alloy Ribbon Piece

Here, the "nanocrystalline alloy ribbon piece" means a nanocrystalline alloy ribbon piece that provides desired properties of soft magnetic properties such as a coercivity by precipitating fine crystal grains without substantially causing the coarse crystal grains or the precipitation of the compound phase. The material of the nanocrystalline alloy ribbon piece differs depending on the material and the like of the amorphous alloy ribbon piece, and when the material of the amorphous alloy ribbon piece is the Fe-based amorphous alloy, the material of the nanocrystalline alloy ribbon piece is, for example, a Fe-based nanocrystalline alloy having a mixed phase structure of crystal grains of Fe or Fe alloy (for example, fine bccFe crystal) and amorphous phases.

The grain diameter of the crystal grain of the nanocrystalline alloy ribbon piece is not specifically limited insofar as the desired soft magnetic properties are obtained, and differs depending on the material and the like. When the material is the Fe-based nanocrystalline alloy, for example, the grain diameter is in a range of 25 nm or less in some embodiments. This is because coarsening deteriorates the coercivity. The grain diameter of the crystal grain can be measured through, for example, a direct observation using a transmission electron microscope (TEM). The grain diameter of the crystal grain can be estimated from the coercivity or the temperature history of the nanocrystalline alloy ribbon piece.

The saturation magnetic flux density of the nanocrystalline alloy ribbon piece differs depending on the material and the like of the nanocrystalline alloy ribbon piece, and when the material is the Fe-based nanocrystalline alloy, the saturation magnetic flux density is, for example, 1.7 T or more in some embodiments. This is because, for example, the torque of the motor and the like can be increased. The coercivity of the nanocrystalline alloy ribbon piece differs depending on the material and the like of the nanocrystalline alloy ribbon piece, and when the material is the Fe-based nanocrystalline alloy, the coercivity is, for example, 20 A/m or less and is 10 A/m or less in some embodiments. This is because, thus decreasing the coercivity ensures effectively reducing, for example, a loss in the core of the motor and the like. The saturation magnetic flux density and the coercivity can be measured using, for example, a vibrating sample magnetometer (VSM).

(2) Method for Manufacturing Alloy Ribbon Piece

The method for manufacturing alloy ribbon piece is not specifically limited insofar as the method is a method for manufacturing a alloy ribbon piece obtained by crystallizing the amorphous alloy ribbon piece, the method includes the preparation step, the first temperature increasing step, and the second temperature increasing step, and the temperature increase rate of the amorphous alloy ribbon piece in the second temperature increasing step satisfies the formula (1). For example, as the example illustrated in FIG. 1A to FIG. 3C, the method prepares a plurality of the amorphous alloy ribbon pieces in the preparation step, increase the temperature of the plurality of amorphous alloy ribbon pieces to the crystallization starting temperature in the first temperature increasing step, and increase the temperature of the plurality of amorphous alloy ribbon pieces from the crystallization starting temperature to the crystallization process termination temperature in the state where the clearances are provided between the adjacent amorphous alloy ribbon pieces such that the temperature increase rates of the plurality of amorphous alloy ribbon pieces each satisfy the formula (1) in the second temperature increasing step in some embodiments. This is because, since the excessive temperature increase of the plurality of amorphous alloy ribbon pieces can be suppressed while simultaneously crystallizing them in one temperature increase process, the alloy ribbon having excellent soft magnetic properties can be easily mass-produced.

The clearance provided between the alloy ribbon pieces in the method where the temperature of the plurality of amorphous alloy ribbon pieces is increased in the state where the clearance is provided between the adjacent amorphous alloy ribbon pieces in the second temperature increasing step is not specifically limited insofar as the heat is sufficiently discharged by the clearance for each of the amorphous alloy ribbon pieces, thereby suppressing the excessive temperature increase for each of the amorphous alloy ribbon pieces to ensure manufacturing the plurality of alloy ribbon pieces having the desired soft magnetic properties. The clearance is, for example, 1 mm or more in some embodiments. This is because the heat is effectively discharged.

While the atmosphere to perform the steps included in the method for manufacturing alloy ribbon piece is not specifically limited, for example, the air atmosphere is included.

While the method for manufacturing alloy ribbon piece is not specifically limited insofar as the alloy ribbon piece having the desired soft magnetic properties can be manufactured, the method may be, for example, a manufacturing method where the whole of the amorphous alloy ribbon piece is crystallized to obtain a desired grain diameter of the crystal grain of the crystallized alloy ribbon piece without substantially causing the burning due to the excessive temperature increase, the coarse crystal grains, or the precipitation of the compound phase. In the method for manufacturing alloy ribbon piece, in order to crystallize the whole of the amorphous alloy ribbon piece to obtain the desired grain diameter of the crystal grain of the crystallized alloy ribbon piece without substantially causing the burning due to the excessive temperature increase, the coarse crystal grains, or the precipitation of the compound phase, other conditions may be appropriately set in addition to the above-described conditions. Not only the respective conditions are appropriately set independently, but also combinations of the respective conditions may be appropriately set.

EXAMPLES

The following further specifically describes the method for manufacturing alloy ribbon piece according to the embodiment with Example and Comparative Examples.

Example

First, as illustrated in FIG. 1A, a continuous sheet-shaped amorphous alloy ribbon (NANOMET manufactured by Tohoku Magnet Institute Co., Ltd.) manufactured by a common method was punched with a pressing machine P to manufacture and prepare 400 (not correctly illustrated) amorphous alloy ribbon pieces 2A (preparation step). The amorphous alloy ribbon pieces 2A are each a ribbon having a shape into which an annular alloy ribbon constituting a stator core of a motor was divided in a circumferential direction in one third, and each have the size, the crystallization starting temperature and the crystallization completion temperature, and the saturation magnetic flux densities and the coercivities at respective positions in the planar direction below.

Thickness: 25 μm
Radial Length: 35 mm
Inner Edge Length: 130 mm
Outer Edge Length: 210 mm
Crystallization Starting Temperature: 419.19° C.
Crystallization Completion Temperature: 500° C.
Saturation Magnetic Flux Density: less than 1.7 T
Coercivity: less than 6 A/m Next, as illustrated in FIG. 1B, 400 amorphous alloy ribbon pieces 2A were laminated to form the laminated body 10A. Subsequently, as illustrated in FIG. 1C and FIG. 2A, the laminated body 10A was put sideways, and a jig J including a pair of plate-shaped members was used to fix the laminated body 10A by sandwiching the 400 amorphous alloy ribbon pieces 2A at circumferential both ends with the clearance S of 1 mm provided between the adjacent amorphous alloy ribbon pieces 2A.

Next, as illustrated in FIG. 2B and the temperature history A of FIG. 4, the 400 amorphous alloy ribbon pieces 2A were moved from the environment of normal temperature to inside the heating furnace F where the temperature was set to 400° C., thereby increasing the temperature of the 400 amorphous alloy ribbon pieces 2A to 400° C.

Next, as illustrated in FIG. 2C and the temperature history A of FIG. 4, the temperature of the heating furnace F was increased from 400° C. to 460° C. in 10 seconds at a uniform temperature increase rate (6° C./second). With this process, in the state where the clearances S were provided between the adjacent amorphous alloy ribbon pieces 2A, the temperature of the 400 amorphous alloy ribbon pieces 2A was increased from 400° C. to 419.19° C. (crystallization starting temperature) at the uniform temperature increase rate (6° C./second), and subsequently, increased from 419.19° C. (crystallization starting temperature) to 460° C. (crystallization process termination temperature), which was equal to or less than the crystallization completion temperature, at the uniform temperature increase rate (6° C./second) (first temperature increasing step and second temperature increasing step). Through the second temperature increasing step, the 400 amorphous alloy ribbon pieces 2A were each entirely crystallized to form 400 alloy ribbon pieces 2C.

Next, as illustrated in FIG. 3A, the 400 alloy ribbon pieces 2C were taken out from inside the heating furnace F and moved to the environment of normal temperature to cool the 400 alloy ribbon pieces 2C to the normal temperature, thus stopping the growth of crystallized crystal grains, and the 400 alloy ribbon pieces 2C are brought in close contact with one another using a pressure to form the laminated body 10B (cooling step). Thus, 400 alloy ribbon pieces 2C where the 400 amorphous alloy ribbon pieces 2A have been each entirely crystallized were manufactured.

Comparative Example 1

As indicated by the temperature history B of FIG. 4, the temperature of the 400 amorphous alloy ribbon pieces 2A was increased to 400° C., and subsequently the temperature of the heating furnace F was kept at 400° C. for 10 seconds. Thus, 400 alloy ribbon pieces were manufactured with the manufacturing method similar to that of Example excluding the keeping at 400° C. for 10 seconds.

Comparative Example 2

As indicated by the temperature history C of FIG. 4, the temperature of the 400 amorphous alloy ribbon pieces 2A was increased to 460° C. by moving the 400 amorphous alloy ribbon pieces 2A from the environment of normal temperature to the inside of the heating furnace F where the temperature was set to 460° C., and subsequently the temperature of the heating furnace F was kept at 460° C. for 10 seconds. Thus, the manufacturing method similar to that of Example excluding the keeping at 460° C. for 10 seconds was performed. As a result, the amorphous alloy ribbon pieces 2A each became red-hot and burnt. It is considered that because of the simultaneous temperature increase of the whole amorphous alloy ribbon piece 2A to the temperature equal to or more than the temperature at which the amorphous alloy was crystallized, the self-heating due to the crystallization occurred at the whole amorphous alloy ribbon piece 2A, resulting in the excessive temperature increase of the amorphous alloy ribbon piece 2A.

Comparative Example 31

As indicated by the temperature history D of FIG. 4, in the first temperature increasing step and the second temperature increasing step, the temperature of the heating furnace F was increased from 400° C. to 460° C. in five seconds at a uniform temperature increase rate (12° C./second). Thus, the manufacturing method was performed, and the manufacturing method was similar to that of Example excluding that the temperature of the 400 amorphous alloy ribbon pieces 2A was increased from 400° C. to 419.19° C. (crystallization starting temperature) at the uniform temperature increase rate (12° C./second) and subsequently increased from 419.19° C. (crystallization starting temperature) to 460° C. (crystallization process termination temperature) at the uniform temperature increase rate (12° C./second) in the state where the clearances S were provided between the adjacent amorphous alloy ribbon pieces 2A. As a result, the amorphous alloy ribbon pieces 2A each became red-hot and burnt. It is considered that because of the temperature increase rate of the amorphous alloy ribbon piece 2A in the second temperature increasing step not satisfying the formula (1), the self-heating due to the crystallization occurred in chain reaction at the amorphous alloy ribbon piece 2A, resulting in the excessive temperature increase of the amorphous alloy ribbon piece 2A.

Comparative Example 4

As indicated by the temperature history E of FIG. 4, in the first temperature increasing step and the second temperature increasing step, the temperature of the heating furnace F was increased from 400° C. to 460° C. in 300 seconds at a uniform temperature increase rate (0.2° C./second). Thus, the manufacturing method was performed, and the manufacturing method was similar to that of Example excluding that the temperature of the 400 amorphous alloy ribbon pieces 2A was increased from 400° C. to 419.19° C. (crystallization starting temperature) at the uniform temperature increase rate (0.2° C./second) and subsequently increased from 419.19° C. (crystallization starting temperature) to 460° C. (crystallization process termination temperature) at the uniform temperature increase rate (0.2° C./second) in the state where the clearances S were provided between the adjacent amorphous alloy ribbon pieces 2A. Thus, 400 alloy ribbon pieces 2C were manufactured.

[Evaluation]

One alloy ribbon piece was selected from the 400 alloy ribbon pieces manufactured by each of Example, Comparative Example 1, and Comparative Example 4 where the amorphous alloy ribbon piece 2A did not burn among Example and Comparative Examples, a part of the one alloy ribbon piece was cut out, and the saturation magnetic flux density and the coercivity were measured by VSM (vibrating sample magnetometer) in the part of the one alloy ribbon piece. Table 1 below indicates the measurement values.

TABLE 1

| | Heating Process Conditions | Evaluation of Saturation Magnetic Flux Density and Coercivity | |
|---|---|---|---|
| | of Amorphous Alloy Ribbon Piece in Second Temperature Increasing Step | Saturation Magnetic Flux Density [T] | Coercivity [A/m] |
| Example | Temperature Increase from 400° C. to 460° C. in 10 Seconds | 1.74 | 7.38 |
| Comparative Example 1 | Keep at 400° C. for 10 Seconds | 1.57 | 9.44 |
| Comparative Example 2 | Keep at 460° C. for 10 Seconds | — | — |
| Comparative Example 3 | Temperature Increase from 400° C. to 460° C. in 5 Seconds | — | — |
| Comparative Example 4 | Temperature Increase from 400° C. to 460° C. in 300 Seconds | 1.74 | 49.8 |

As indicated by Table 1 above, in Example, the saturation magnetic flux density was equal to or more than the lower limit (1.7 T) of the target range, and the coercivity was within the target range without exceeding the upper limit (10 A/m) of the target range. It is considered that the temperature increase rate of the amorphous alloy ribbon piece 2A in the second temperature increasing step satisfying the formula (1) suppressed the occurrence in chain reaction of the self-heating due to the crystallization at the amorphous alloy ribbon piece 2A, thereby suppressing the excessive temperature increase of the amorphous alloy ribbon piece 2A, and the not excessively long temperature increasing time of the amorphous alloy ribbon piece 2A in the second temperature increasing step suppressed the growth of the crystallized crystal grains for a long period of time to be coarsened.

Meanwhile, in Comparative Example 1, while the coercivity did not exceed the upper limit of the target range, the saturation magnetic flux density was less than the lower limit of the target range. It is considered that because of the temperature increase of the whole amorphous alloy ribbon piece 2A only up to 400° C., the amorphous alloy ribbon piece 2A was not entirely crystallized. In Comparative Example 4, while the saturation magnetic flux density was the lower limit or more of the target range the coercivity significantly exceeded the upper limit of the target range. It is considered that because of the excessively long temperature increasing time of the amorphous alloy ribbon piece 2A in the second temperature increasing step, the crystallized crystal grains grew for a long period of time to be coarsened.

While the embodiment of the method for manufacturing alloy ribbon piece according to the present disclosure have been described in detail above, the present disclosure is not limited thereto, and can be subjected to various kinds of changes in design without departing from the spirit of the present disclosure described in the claims.

All publications, patents and patent applications cited in the present description are herein incorporated by reference as they are.

DESCRIPTION OF SYMBOLS

2A Amorphous alloy ribbon piece

2C Alloy ribbon piece (nanocrystalline alloy ribbon piece) obtained by crystallizing amorphous alloy ribbon piece S Clearance provided between alloy ribbon pieces F Heating furnace

What is claimed is:

1. A method for manufacturing an alloy ribbon piece obtained by crystallizing an amorphous alloy ribbon piece, the method comprising:

preparing an amorphous alloy ribbon piece;

disposing the amorphous alloy ribbon piece inside a heating furnace;

heating the amorphous alloy ribbon piece that is disposed inside the furnace to a crystallization starting temperature; and upon reaching the crystallization starting temperature, increasing the temperature of the amorphous alloy ribbon piece from the crystallization starting temperature to a crystallization process termination temperature equal to or less than a crystallization completion temperature by increasing the temperature inside the heating furnace, wherein a temperature increase rate of the amorphous alloy ribbon piece in the increasing of the temperature of the amorphous alloy ribbon piece from the crystallization starting temperature to the crystallization process termination temperature satisfies a formula (1) below where a self-heating amount of the amorphous alloy ribbon piece per unit time is $\Delta Q_{self}$, a heat discharge amount of the amorphous alloy ribbon piece per unit time is $\Delta Q_{out}$, a mass and a specific heat of the amorphous alloy ribbon piece are m and c, respectively, and a temperature increase width of the amorphous alloy ribbon piece per unit time is $\Delta T$ $$\Delta Q_{self} \leq \Delta Q_{out} + mc\Delta T \quad (1),$$

wherein a plurality of the amorphous alloy ribbon pieces are prepared in the preparing, wherein the heating of the amorphous alloy ribbon piece to the crystallization starting temperature increases the temperature of the plurality of amorphous alloy ribbon pieces to the crystallization starting temperature, and wherein the increasing of the temperature of the amorphous alloy ribbon piece from the crystallization starting temperature to the crystallization process termination temperature increases the temperature of the plurality of amorphous alloy ribbon pieces from the crystallization starting temperature to the crystallization process termination temperature in a state where clearances are provided between the adjacent amorphous alloy ribbon pieces such that the temperature increase rates of the plurality of amorphous alloy ribbon pieces each satisfy the formula (1).

2. The method for manufacturing the alloy ribbon piece according to claim 1, wherein a material of the amorphous alloy ribbon piece is a Fe-based amorphous alloy, and wherein an average temperature increase rate of the amorphous alloy ribbon piece in the increasing of the temperature of the amorphous alloy ribbon piece from the crystallization starting temperature to the crystallization process termination temperature is in a range of 0.5° C./second or more and 20° C./second or less.

* * * * *